United States Patent [19]

Bauer, Jr.

[11] Patent Number: 4,757,989

[45] Date of Patent: Jul. 19, 1988

[54] MARTIAL ARTS BOARD HOLDING DEVICE

[76] Inventor: William J. Bauer, Jr., 4962 Robert Ave., St. Louis, Mo. 63109

[21] Appl. No.: 898,591

[22] Filed: Aug. 21, 1986

[51] Int. Cl.[4] ..... A63B 69/00; F16M 13/00

[52] U.S. Cl. ..... 272/76; 248/421; 248/432; 108/145

[58] Field of Search ..... 272/76, 77, 78, 900; 248/164, 421, 432; 108/6, 145; 273/407

[56] References Cited

U.S. PATENT DOCUMENTS

| | | | |
|---|---|---|---|
| 1,611,432 | 12/1926 | Gladstone | 248/421 |
| 4,491,316 | 1/1985 | Prince | 272/76 |
| 4,572,504 | 2/1986 | Di Bartolo | 272/76 |

OTHER PUBLICATIONS

"Power Fist" Board Holder, Black Belt Magazine, Jan. 1976, p. 18.

*Primary Examiner*—Richard J. Apley
*Assistant Examiner*—S. R. Crow
*Attorney, Agent, or Firm*—Rogers, Howell, Moore & Haferkamp

[57] ABSTRACT

A portable martial arts device for rigidly holding one or more boards to receive a karate blow or the like. The device comprises a freestanding framework and a board holder mounted on the framework for rigidly holding parallel edge margins of one or more boards thereby to position the boards for receiving a karate blow or the like. A mechanism is provided for mounting the board holder on the framework for pivotal movement about a generally horizontal axis thereby to permit adjustment of the angular position of one or more boards in the holder. The framework is adapted for adjustment of the height of the board holder, thereby permitting adjustment of the height of boards in the holder.

9 Claims, 3 Drawing Sheets

MARTIAL ARTS BOARD HOLDING DEVICE

BACKGROUND OF THE INVENTION

This invention relates generally to a device for holding a board, and more particularly to a martial arts device for rigidly holding one or more boards to receive a karate blow or the like.

Often in the practice of the martial arts it is desired to break boards with kicks and other blows. Typically, such boards must be rigidly held along their marginal edges either by the hands of a person other than the one breaking the board, or by a board holding device.

Kicks and other blows may be struck with horizontal movement or vertical movement, or may be angled upwardly or downwardly. Further, the kicks and other blows may be delivered at a wide variety of heights. Thus, it is desirable that the boards be able to be held at various angles and heights for reception of such kicks and other blows.

In the face of sharp blows, it is difficult to hold the boards rigidly by hand, especially at any angle other than that where the face of the board is vertical. It is also difficult to hold boards rigidly by hand at different heights within a wide range of possible heights. Moreover, although it is sometimes desired to break a group of boards stacked together, it is difficult to hold more than a very few boards at one time because the cumulative thickness renders the stack of boards difficult to grip firmly. In addition, holding boards by hand may be dangerous. For example, the skin of the hands may be pinched between the boards, or the holder may be injured by the forcefully moving hand, arm, foot or head of the striker, or by flying pieces of the broken board, or by the force of impact itself.

Several problems exist with conventional board holding devices, which generally comprise a U-shaped device or an open-end box having slots or L-shaped brackets adjacent its open end for holding boards by their marginal adges. Such devices typically are adapted to be attached to a wall for rigid support. Thus, such devices are not useful away from walls. Further, due to the relative permanency of the wall attachment devices, and the difficulty of repeated attachment and detachment of the board holding devices, such devices are not readily portable. Similarly, once installed, the height of the board holder typically cannot be varied. In addition, attachment to a wall marrs the wall, and blows against the device risk damage to the wall.

Another disadvantage of prior art martial arts board holders is that while some board holders may permit some variation in board angle, the range of adjustment is severely limited. Since the conventional holder is usually mounted on a wall, the blow it accepts must be directed substantially into the wall, that is, substantially horizontal in direction. This is unduly restrictive in that it is desirable to strike boards with blows from directions ranging from nearly upward to nearly downward.

Still another disadvantage of prior art board holders is that the direction of the grain of the board relative to a person striking the board cannot be varied. It is known in this regard that upon a blow to a wooden board, the board will tend to break along the grain as opposed to across the grain, since far greater force is required to break the board across the grain. Thus, for breaking boards, the boards should be held along the marginal board edges which run generally parallel to the grain, and not along the marginal board edges which run across the grain. At times it is desired to break boards with the grain aligned generally vertically, and at other times with the grain aligned generally horizontally. However, prior art martial arts board holders are adapted to either grip the board only along the vertical marginal edges or only along the horizontal marginal edges. Thus, boards must always be held with the grain in the same alignment.

SUMMARY OF THE INVENTION

Among the several objects of the present invention, therefore, may be noted the provision of a martial arts device for rigidly holding one or more boards in a position to receive kicks and other blows; the provision of such device that is portable; the provision of such device that is free-standing; the provision of such device that is adjustable to hold a variable number of boards; the provision of such device that is adjustable to hold boards at a variety of different heights within a wide range of heights; the provision of such device that is adjustable to hold boards at a variety of angles within a wide range of angles; the provision of such device which holds wood boards along marginal board edges substantially parallel to the grain and which is adjustable so that the grain of the boards can be oriented so that the grain runs either generally vertically or generally horizontally.

Briefly, the present invention is directed to a novel portable martial arts device for rigidly holding one or more boards to receive a karate blow or the like. The device comprises a freestanding framework and a board holder mounted on the framework having means for rigidly holding parallel edge margins of one or more boards thereby to position the boards for receiving a karate blow or the like. Means is provided for mounting the board holder on the framework for pivotal movement about a generally horizontal axis thereby to permit adjustment of the angular position of one or more boards in the holder. The framework is adapted for adjustment of the height of the board holder, thereby permitting adjustment of the height of boards in the holder.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
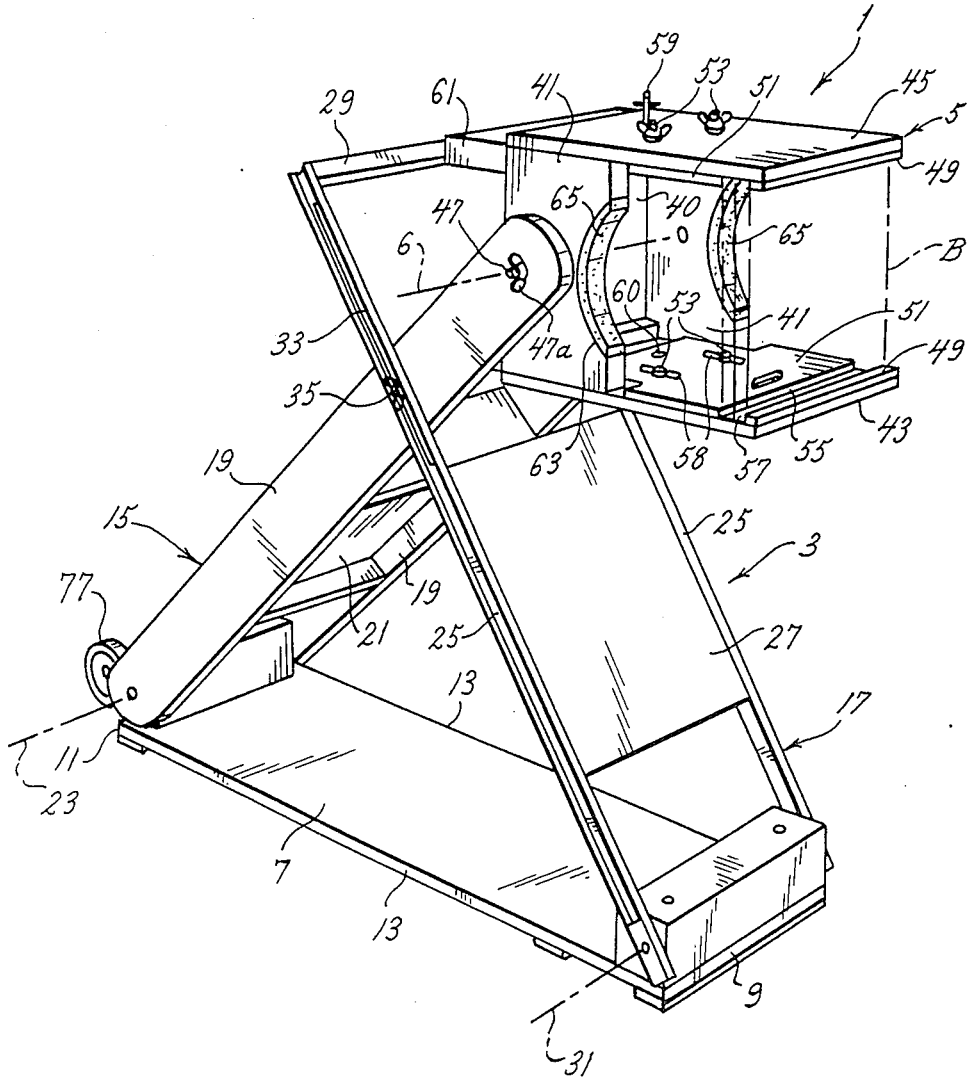
FIG. 1 is a perspective of a martial arts board holding device of this invention.
Figure 3:
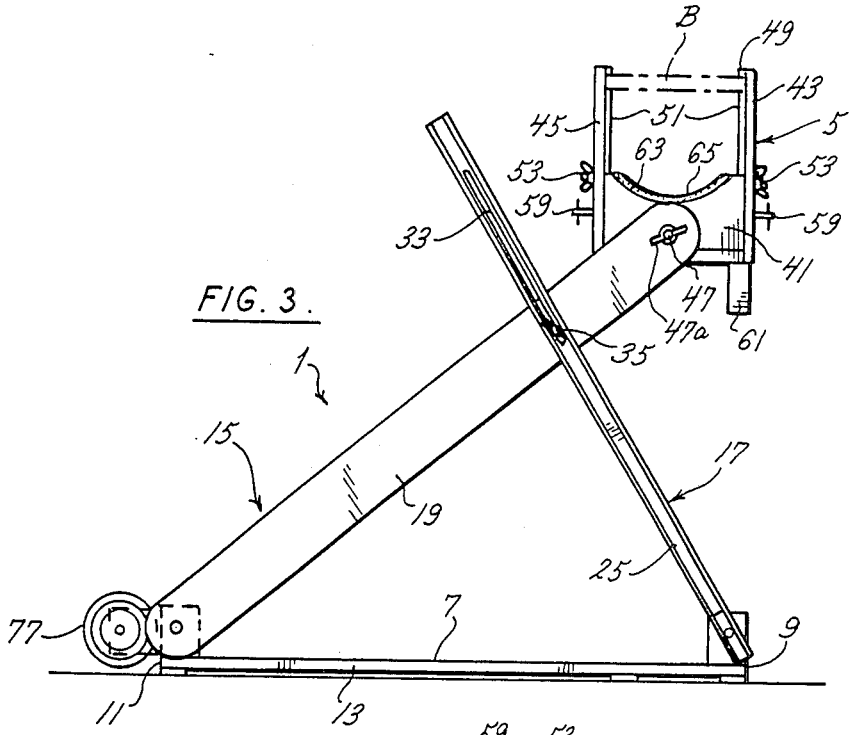
FIG. 3 is a side elevation of the board holding device with the board holder in a second position.

Referring now to FIG. 1 of the drawings, there is generally indicated at 1 a portable martial arts device of this invention for rigidly holding one or more boards B to receive a karate blow or the like. The device comprises a free-standing framework generally designated 3 and a board holder generally designated 5 mounted on the framework for pivotal movement about a generally horizontal axis 6 thereby to permit adjustment of the angular position of one or more boards in the holder. As will appear, the framework is also adapted for adjustment of the height of the board holder.

More specifically, the framework comprises a generally rectangular horizontal base 7 having a front 9, back 11 and opposite sides each designated 13, a support member generally indicated at 15 and a brace member generally indicated at 17. As shown in FIG. 1, the support member 15 comprises two parallel side members, each designated 19, and a central panel 21 connecting the side members. The side members are pivoted at their lower ends to the base 7 at the back 11 of the base to enable the support member to swing about a generally horizontal axis 23 extending in generally side-to-side direction with respect to the base. The board holder 5 is carried between the two side members 19 at their upper ends, the arrangement being such that the height of the board holder may be adjusted by swinging the support member up and down on axis 23.

Figure 6:
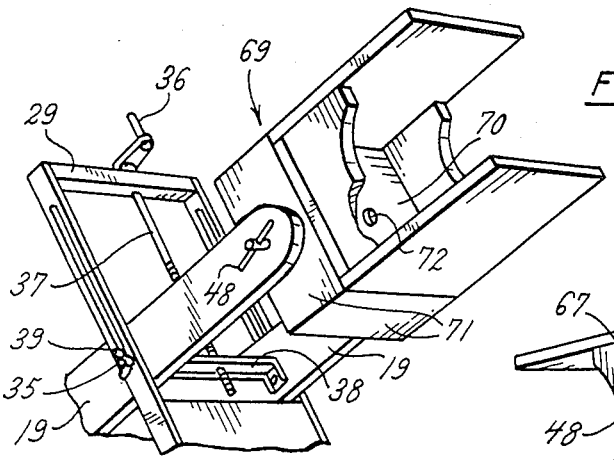
FIG. 6 is an enlarged perspective view of a second embodiment of the board holding device, portions of the board holder being broken away for purposes of illustration.
Figure 7:
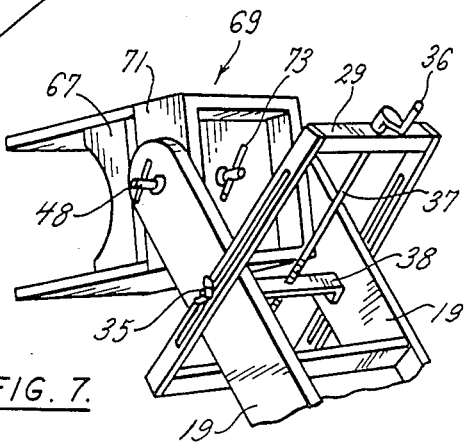
FIG. 7 is an enlarged perspective view of a second embodiment of the board holding device.

The brace member 17 preferably comprises two parallel side rails 25 connected by a center panel 27 and a crossbar 29 at the upper ends of the rails. The side rails 25 are pivoted at their lower ends on the base 7 adjacent the front 9 of the base to enable the brace member 17 to swing about a generally horizontal axis 31 extending transversely of the base forward of axis 23. As shown in the drawings, the side rails 25 of the brace member angle upwardly and rearwardly from the base 7 and extend on the outside of the side members 19 of the support member. The side rails 25 and side members 19 are connected by a pair of pin-and-slot connections (only one shown in FIG. 1), the slots 33 of the connections being in side rails 25 and the pins 35 on the side members 19. The arrangement is such that the pins are movable in the slots to permit swinging of the brace and support members 15, 17 about their respective axes to adjust the height of the board holder 5. To facilitate height adjustment, crank means, as shown in FIGS. 6 and 7, may be provided comprising a crank 36 attached to a threaded rod 37 which extends through crossbar 29 on brace member 17 and is threaded 1nto crossbracket 38 spanning the parallel side member 19 of support member 15. It is apparent that by turning crank 36 rod 37 is rotated, which causes cross-bracket 38 to move toward or away from crossbar 29 for varying the height of board holder 5. Suitable means such as wingnuts 39 threadable on pins 35 (which may be bolts, for example) are provided for securing the support and brace members in fixed position with respect to one another. It will be understood, therefore, that the brace member 17, the pin-and-slot connections and the wingnuts 39 combine to provide means for securing the support member 15 in selected angular position when the board holder 5 is at the desired height.

By way of example, the side members 19 may be about four and one-half feet long, the base 7 about four feet long, and slots 33 about one and one-half to two feet long. The pins 35 on the side members 19 of the support member 15 are preferably situated about three-fourths of the way toward the free upper ends of the members 19. These dimensions allow board holder 14 to be adjusted to any height from under three feet to over four feet.

Figure 2:
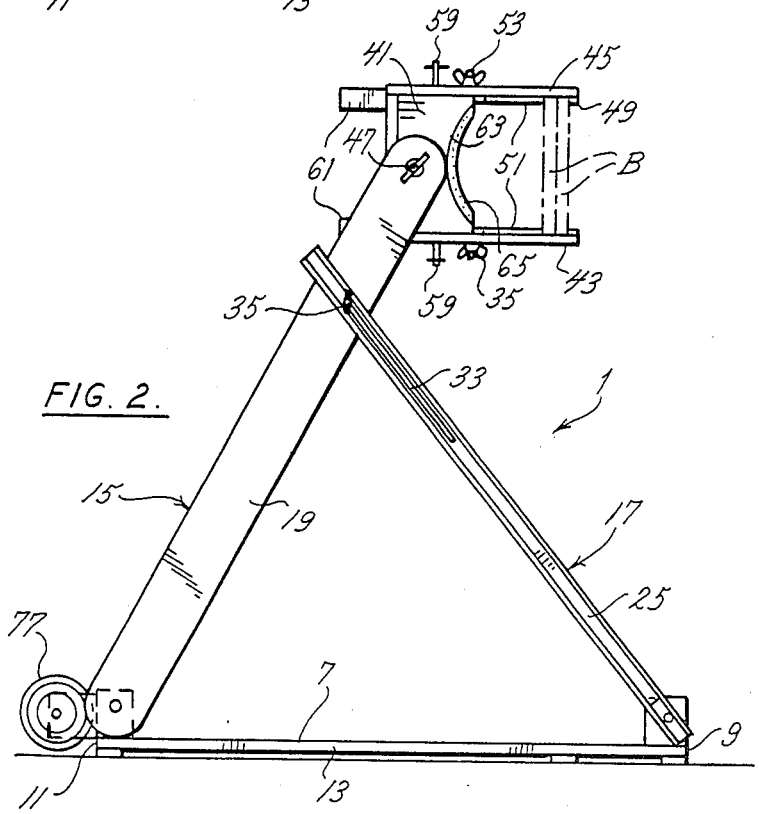
FIG. 2 is a side elevation of the board holding device of FIG. 1 with the board holder in one position.
Figure 4:
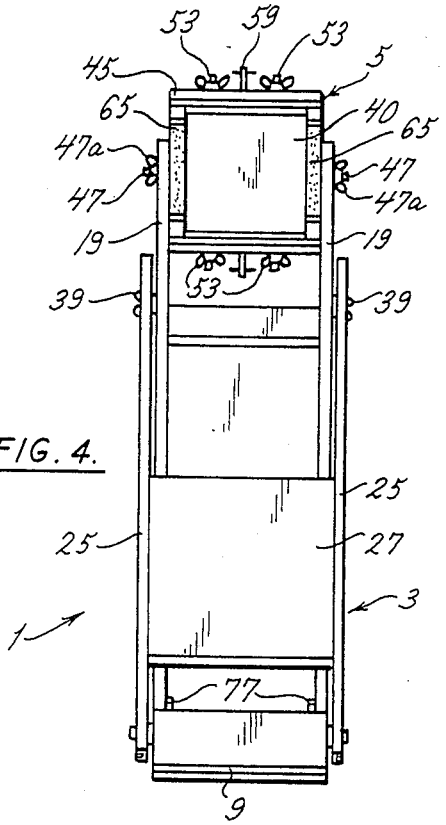
FIG. 4 is a front elevation view of the board holding device.

In the configuration as shown in FIGS. 1–4, board holder 5 is substantially U-shaped when viewed from the side as in FIG. 2, and comprises a back panel 40, side panels, each designated 41, bottom arm 43 and top arm 45. Board holder 5 has a width when viewed from the front, as in FIG. 4, such that the width spans the distance between the insides of parallel side members 19 of support member 15, preferrably about one foot. Board holder 5 is pivotably connected to the free end of support member 15 by means of bolts 47 extending through the upper ends of parallel side members 19 of support member 15 and the side panels 41 of board holder 5, as shown in the drawings. Board holder 5 can thereby be pivoted on bolts 47 about axis 6 and secured in selected angular position by tightening wing nuts 47*a* threaded on bolts 47. Alternatively, cross bar clamping handles 48 may be threaded on bolts 47 as shown in FIGS. 6 and 7 (bolts 47 not shown in FIGS. 6 and 7), and board holder 5 would thereby be secured in selected angular position by tightening clamping handles 48. FIGS. 1 and 2 illustrate a martial arts device of this invention with board holder 5 set at two possible angles.

In the employment of a device of this invention, one or more boards B are held at the outer free ends of arms 43 and 45 of board holder 5. Lips 49 formed from flat iron, sheet metal or a narrow bar of metal or wood or the like are attached to the inside faces of the two arms 43 and 45, as shown in FIG. 1. Flat board-restraining plates 51 are mounted on the inside faces of arms 43 and 45 by means of bolts and wing nuts 53. The forward edge 55 of each plate 51, in combination with corresponding lip 49, defines a generally horizontal board-receiving channel 57. Thus, a pair of spaced-apart generally parallel channels 57 opening inwardly towards one another are formed for receiving the marginal edges of one or more boards B. Typically, boards of dimensions 1 ft.×1 ft.×1 in. thick are employed. Thus, the distance between the arms 43 and 45 may be about one foot. Boards B are inserted into the board holder 5 by sliding the boards into channels 57 from the side of board holder 5. Wood boards should be oriented such that the wood grain runs substantially parallel to the length of channels 57, that is, generally horizontal in the configuration of the martial arts device shown in FIG. 1. Such orientation of the boards allows easier breakage of the boards, since wood tends to break along the grain, not against the grain.

Plates 51 are bolted to arms 43 and 45 through slots 58 in the plates 51. Thus, by loosening nuts 53, the plates may be moved toward or away from lips 49 and then secured in adjusted position by retightening nuts 53. In this manner, the width of channels 57 can be varied to accommodate one or more boards B, as desired. In a preferred embodiment, slots 58 are of length such that when plates 51 are all the way forward, one board is accommodated by channels 57, and when plates 51 are all the way back, three boards are accommodated by channels 57. In this embodiment, it has been found that greater stability is achieved in an intermediate two-board position when a restraining pin 59 is inserted into a hole in each of bottom arm 43 and top arm 45 and through a corresponding hole 60 in each plate, holes 60 being positioned for receiving restraining pin 59 when plates 51 are in the two-board position.

Figure 5:
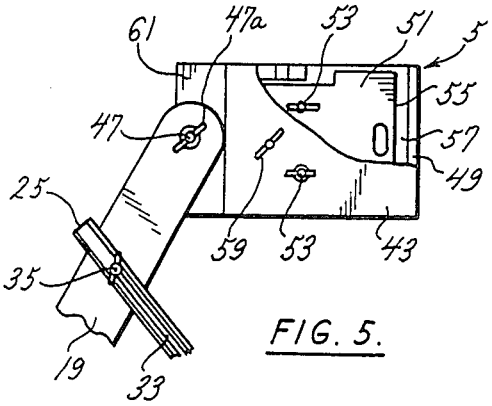
FIG. 5 is an enlarged side elevation view of the board holding device with the board holder in a third position, portions of the board holder being broken away for purposes of illustration.

Parallel flanges 61 project out from back panel 40 away from the open end of board holder 5, but parallel to arms 43 and 45. Flanges 61 are spaced apart and oriented so that board holder 5 may be disconnected from framework 3, turned ninety degrees such that channels 57 extend generally vertically instead of generally horizontally, and then reconnected to the free ends of side members 19 by means of flanges 61, shown in FIG. 5. In this configuration, wood boards B can be inserted with grain running generally vertically instead of generally horizontally, if so desired. Board holder 5 is also pivotable about a horizontal axis in this configuration. A stop may be attached to one end of a channel 57 to act as a stop preventing the boards from sliding out of one end of the channels 57 when board holder 5 is in this configuration.

Generally, the depth of the board holder 5, that is, the distance from channels 57 to the back panel 40 of the board holder 5, should be sufficient to allow for the follow-through of the portion of the body striking the board. Likewise, side panels 41 extend only a short distance from the back of board holder 5 toward channels 57. In addition, side panels 41 may be cut to have arcuate forward edges 63. The risk of injury caused by unintentionally striking forward edges 63 on the follow-through of a blow may be reduced by covering at least a portion of forward edges 63 with pads 65.

In an alternative embodiment, illustrated in FIGS. 6 and 7, the board-holding mechanism comprises a head 67, which is similar to the board holder 5 described above (with corresponding parts being identified by the same reference numerals), but without flanges 61, and a head mount 69 comprising a face 70 and sides 71. Head mount 69 is pivotably connected to the free end of support member 15 by means of bolts 47 (not shown in FIGS. 6 and 7) extending through the upper ends of parallel side members 19 of support member 15 and opposing sides 71 of head mount 69 so that the head mount 69 can be pivoted on bolts 47 about axis 6 and secured in selected angular position by tightening cross bar clamping handles 48 threaded on bolts 47. A head bolt 72 extends through a central hole in back panel 39 of head 67 and a central hole in face 70 of head mount 69. Head 67 can thereby be rotated about hex head bolt 72 to vary the angle of the grain of the board(s) held within head 67. The head 67 is secured in selected position by tightening a crossbar clamping handle 73 threaded on hex head bolt 72.

Portability of the martial arts device of this invention may be enhanced by the use of wheels 77 at one end of the base 7. The wheels should be attached so that they are suspended above the ground when the base 7 is placed flat on the ground. Thus, movement of the device to a new location, for example, into or out of a store room, to or away from a tournament area or to or from a car or truck, can be accomplished simply by tilting the device onto the wheels, and rolling the device.

To increase the stability and inertia of the apparatus so that it remains substantially stationary upon the delivery of sharp blows to the boards held therein, portable weights may be placed on base 7. It has been found that two, three or four 30 pound weights are sufficient for this purpose.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable martial arts device for rigidly holding one or more boards to receive a karate blow or the like, comprising:

a freestanding framework;

a board holder mounted on the framework having means for rigidly holding parallel edge margins of one or more boards thereby to position the boards for receiving a karate blow or the like, said holding means comprising a pair of spaced-apart generally parallel channels opening inwardly towards one another for receiving therein said parallel edge margins of one or more boards, said board holder being adapted to be mounted on said framework in a first position in which said channels extend in generally side-to-side dirction with respect to the base and a second position in which said channels extend generally perpendicular to said side-to-side direction;

means mounting the board holder on the framework for pivot movement about a generally horizontal axis thereby to permit adjustment of the angular position of one or more boards in the holder; and said framework being adapted for adjustment of the height of said board holder thereby to permit adjustment of the height of one or more boards in the holder, and said framework comprising a base having a front, back and opposite sides, a support member pivoted at one of its ends on the base and carrying said board holder at its other free end, said support member being swingable on a generally horizontal axis extending in generally side-to-side direction with respect to the base for adjusting the height of the board holder, and means for securing said support member in selected angular position when the board holder is at a desired height.

2. A portable martial arts device as set forth in claim 1 wherein said board holder pivot axis and support member pivot axis lie in generally parallel vertical planes extending generally transversely of the base.

3. A portable martial arts device as set forth in claim 2 wherein said means for securing said support member in selected position comprises a brace member pivoted on the base for swinging on a generally horizontal axis extending in generally side-to-side direction with respect to the base at a location spaced forward of said support member pivot axis, pin-and-slot connection means connecting said brace member and the support member and permitting swinging movement of the members about their respective axes, and fastener means for locking said members in fixed position with respect to one another.

4. A portable martial arts device as set forth in claim 3, further comprising crank means for adjusting the support and brace members with respect to one another to vary the height of said board holder.

5. A portable martial arts device as set forth in claim 3 wherein said board holder comprises a generally U-shaped structure having a pair of substantially parallel outwardly extending arms, and means at the outer free ends of the arms defining said channels for holding said one or more boards.

6. A portable martial arts device as set forth in claim 5 wherein said base has wheels thereon.

7. A portable martial arts device for rigidly holding one or more boards to receive a karate blow or the like, comprising:

a freestanding framework;

a board holder mounted on the framework having means for rigidly holding parallel edge margins of one or more boards thereby to position the boards for receiving a karate blow or the like;

means mounting the board holder on the framework for pivotal movement about a generally horizontal axis thereby to permit adjustment of the angular position of one or more boards in the holder; and said framework being adapted for adjustment of the height of said board holder thereby to permit adjustment of the height of one or more boards in the holder, and said framework comprising a base having a front, back and opposite sides, a support member pivoted at one of its ends on the base and carrying said board holder at its other free end, said support member being swingable on a generally horizontal axis extending in generally side-to-side direction with respect to the base for adjusting the height of the board holder, and means for securing said support member in selected angular position when the board holder is at a desired height.

8. A portable martial arts device as set forth in claim 7 wherein said board holder pivot axis and support member pivot axis lie in generally parallel vertical planes extending generally transversely of the base.

9. A portable martial arts device as set forth in claim 8 wherein said means for securing said support member in selected position comprises a brace member pivoted on the base for swinging on a generally horizontal axis extending in generally side-to-side direction with respect to the base at a location spaced forward of said support member pivot axis, pin-and-slot connection means connecting said brace member and the support member while permitting swinging movement of the members about their respective axes, and fastener means for locking said members in fixed position with respect to one another.

* * * * *